US009399235B2

(12) United States Patent
Drugeon et al.

(10) Patent No.: US 9,399,235 B2
(45) Date of Patent: Jul. 26, 2016

(54) PROTECTIVE AND CASING DEVICE FOR A COSMETIC PRODUCT DISPENSING HEAD, ASSOCIATED HEAD, SET AND METHOD

(71) Applicant: L'OREAL, Paris (FR)

(72) Inventors: Lionel Drugeon, La Garenne Colombes (FR); Jean-Marc Lebrand, Pantin (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/433,902

(22) PCT Filed: Oct. 2, 2013

(86) PCT No.: PCT/EP2013/070505

§ 371 (c)(1),
(2) Date: Apr. 7, 2015

(87) PCT Pub. No.: WO2014/056769

PCT Pub. Date: Apr. 17, 2014

(65) Prior Publication Data

US 2015/0273503 A1 Oct. 1, 2015

Related U.S. Application Data

(60) Provisional application No. 61/756,042, filed on Jan. 24, 2013.

(30) Foreign Application Priority Data

Oct. 9, 2012 (FR) ..... 12 59613

(51) Int. Cl.
*B05B 11/00* (2006.01)
*B65D 83/56* (2006.01)
(Continued)

(52) U.S. Cl.
CPC ..... *B05B 11/00* (2013.01); *A45D 34/00* (2013.01); *A45D 34/02* (2013.01); *B05B 11/0032* (2013.01); *B05B 11/3059* (2013.01); *B65D 47/283* (2013.01); *B65D 83/22* (2013.01); *B65D 83/56* (2013.01); *A45D 2200/057* (2013.01)

(58) Field of Classification Search
CPC ..... B05B 11/0027; B05B 11/0032; B05B 11/3059; B65D 50/065; B65D 47/283; B65D 83/22; B65D 83/56; A45D 34/00; A45D 34/02; A45D 2200/057
USPC ..... 222/153.13, 402.11–402.13, 182, 519, 222/522
See application file for complete search history.

(56) References Cited

U.S. PATENT DOCUMENTS 5,499,747 A * 3/1996 Quennessen ..... B65D 83/384 132/320
6,290,103 B1 * 9/2001 Fraillon ..... B65D 47/244 222/321.1

(Continued)

FOREIGN PATENT DOCUMENTS

EP 2 095 883 A1 9/2009
FR WO 0066459 A1 * 11/2000 ..... B65D 83/205

(Continued)

*Primary Examiner* — Nicholas J Weiss
(74) *Attorney, Agent, or Firm* — Polsinelli PC

(57) ABSTRACT

This casing device (22) comprises a member (34) for actuating dispensing of cosmetic product, and a protective band (36). The device (22) comprises an intermediate locking member (38) arranged between the band (36) and the actuating member (34), the intermediate member (38) being suitable for moving between a position for locking the actuating member (34) in an idle position and a position for releasing the actuating member (34), when switching the band (36) between a protective configuration and an operating configuration.

15 Claims, 2 Drawing Sheets

(51) Int. Cl.

| | |
|---|---|
| ***B65D 83/22*** | (2006.01) |
| ***B65D 47/28*** | (2006.01) |
| ***A45D 34/00*** | (2006.01) |
| ***A45D 34/02*** | (2006.01) |

(56) References Cited

U.S. PATENT DOCUMENTS

| | | | | |
|---|---|---|---|---|
| 7,874,461 | B2 * | 1/2011 | Bae | B05B 11/0032 222/153.11 |
| 7,874,465 | B2 * | 1/2011 | Bertin | B05B 11/0032 222/153.11 |
| 8,695,852 | B2 * | 4/2014 | Bertin | B05B 11/0032 222/153.13 |
| 9,010,581 | B2 * | 4/2015 | Presche | B05B 11/0032 222/153.13 |
| 9,186,689 | B2 * | 11/2015 | Kim | B05B 11/3001 |
| 2015/0367367 | A1 * | 12/2015 | Lefevre | B65D 50/065 222/153.13 |

FOREIGN PATENT DOCUMENTS

| | | |
|---|---|---|
| FR | 2 871 712 A1 | 12/2005 |
| FR | 2 953 497 A1 | 6/2011 |

* cited by examiner 14
92
94
71
A
70
34
96
36
38
102
90
A'

S2
S1
106
108
110
112
114
116
100
62
64
66
72

PROTECTIVE AND CASING DEVICE FOR A COSMETIC PRODUCT DISPENSING HEAD, ASSOCIATED HEAD, SET AND METHOD

CROSS REFERENCE TO RELATED APPLICATIONS

This application is a National Phase filing under 35 U.S.C. §371 of PCT/EP2013/070505 filed on Oct. 2, 2013; and this application claims priority to Application No. 1259613 filed in France on Oct. 9, 2012, and this application claims the benefit of U.S. Provisional Application No. 61/756,042 filed on Jan. 24, 2013. The entire contents of each application are hereby incorporated by reference.

The present invention relates to a protective and casing device for a cosmetic product dispensing head to be mounted on the neck of a receptacle, comprising:

- a member for actuating the dispensing of cosmetic product, suitable for moving between an idle position and a cosmetic product dispensing position;
- a protective band, intended to extend around the actuating member in the idle position.

This head is intended to be mounted on a receptacle containing a cosmetic product, in order to dispense the product in product spray or aerosol form. The head is intended to selectively enable or disable dispensing of the product.

The cosmetic product is for example a gel, a cream, a lotion, a perfume or a powder.

"Cosmetic product" means in particular, in the sense of this invention, a product such as defined in EC Regulation no. 1223/2009 of the European Parliament and of the Council of Nov. 30, 2009 relating to cosmetic products.

The cosmetic product will be applied onto a surface of a user's body, such as the user's skin or keratin fibers.

The head is generally mounted on a receptacle comprising, at the upper end thereof, a product dispensing member such as a pump. In this case, the protective and casing device is engaged around the neck of the receptacle, and the actuating member is placed in contact with the dispensing member.

Moving the actuating member from an idle position to a dispensing position causes the product to be dispensed.

To prevent untimely dispensing of cosmetic product when the receptacle is stored, the prior art, particularly FR 2 866 866, FR 2 777 868, WO 00/66 459, or EP 0 987 189, provides for a movable band in relation to the actuating member between a protective configuration wherein the band encompasses the actuating member, and an operating configuration wherein the actuating member protrudes from the band.

In all the above-mentioned devices, the band can be moved simultaneously by means of rotation and translation, by screwing, which does not always give rise to a pleasant procedure.

Furthermore, it is still possible to move the actuating member via the top when the band is in the protective configuration thereof.

FR 2 871 712 describes a casing containing a receptacle equipped with a head, wherein the dispensing head can be partially extracted by means of a translation movement. However, this casing is bulky since it covers the actual receptacle.

One aim of the invention is thus that of obtaining a protective and casing device for a cosmetic product dispensing head, which is easy to handle, compact in size, and guarantees that cosmetic product cannot be dispensed during storage or transport of the receptacle containing the cosmetic product.

For this purpose, the invention relates to a device of the aforementioned type, the band being suitable for moving in a first direction and then in a second direction opposite that of the first direction along a movement axis from a protective configuration of the actuating member, to an operating configuration of the actuating member, wherein the actuating member protrudes from the band, the band being suitable for moving along the axis from the operating configuration to the protective configuration, the device comprising:

- an intermediate locking member arranged between the band and the actuating member, the intermediate member being suitable for moving between a position for locking the actuating member in the idle position thereof and a position for releasing the actuating member, when switching the band between the protective configuration and the operating configuration.

The device according to the invention can include one or more of the following features, considered alone or in any combination that is technically possible:

- the intermediate member is rotatably mounted about the movement axis in relation to the band and the actuating member between the locking position and the releasing position;
- it comprises an actuating mechanism connecting the intermediate member and the band to induce the movement of the intermediate member between the locking position and the releasing position when moving the band between the protective configuration and the operating configuration;
- the actuating mechanism comprises a guiding track provided in the intermediate member and the band, and a guided member rigidly connected to the other of the intermediate member and the band, the guided member being received in the guiding track;
- the guiding track defines at least two regions for stable housing of the guided member at an axial interval along the movement axis;
- it comprises an elastic member for actuating the band to the protective configuration thereof;
- the intermediate member comprises at least one cog, the cog defining an adjacent lateral notch, the actuating member comprising a locking abutment suitable for bearing on the cog in the locking position thereof and suitable for being housed in the notch in the releasing position thereof;
- it comprises a mechanism for locking the band in rotation, the band being suitable for moving solely in translation along the movement axis between the protective configuration and the operating configuration.

The invention also relates to a cosmetic product dispensing head, comprising:

- a cosmetic product dispensing member to be mounted on the neck of a receptacle containing a cosmetic product;
- a device as defined above, covering the dispensing member.

The head according to the invention can include one or more of the following features, considered alone or in any combination that is technically possible:

- a functional gap is provided along the movement axis between the dispensing member and the actuating member in the idle position of the actuating member;
- it comprises an elastic member for actuating the actuating member to the idle position thereof;
- the dispensing member is chosen from a pump or a valve.

The invention also relates to a cosmetic product packaging and dispensing set, characterized in that it comprises a receptacle for receiving the cosmetic product, the receptacle comprising a neck, the set comprising a head as described above, mounted on the neck.

The invention also relates to a cosmetic product dispensing method, comprising the following steps:

- providing a set as described above, the actuating member being positioned in the idle position thereof and the band being positioned in the protective configuration thereof;
- moving the band in a first direction and in a second direction along the movement axis to switch same to the operating configuration;
- switching the intermediate member from the locking position thereof to the releasing position thereof;
- moving the actuating member between the idle position and the dispensing position, to cause the product to be dispensed.

The method according to the invention can include one or more of the following features, taken alone or in any technically possible combination:

- moving the band in the first direction and in the second direction along the movement axis to switch same to the protective configuration;
- switching the intermediate member from the releasing position thereof to the locking position thereof.

The invention will be easier to understand in view of the following description, provided solely as an example, and with reference to the appended drawings, wherein.

Figures 1, 2, 3, 4, 5, 6:
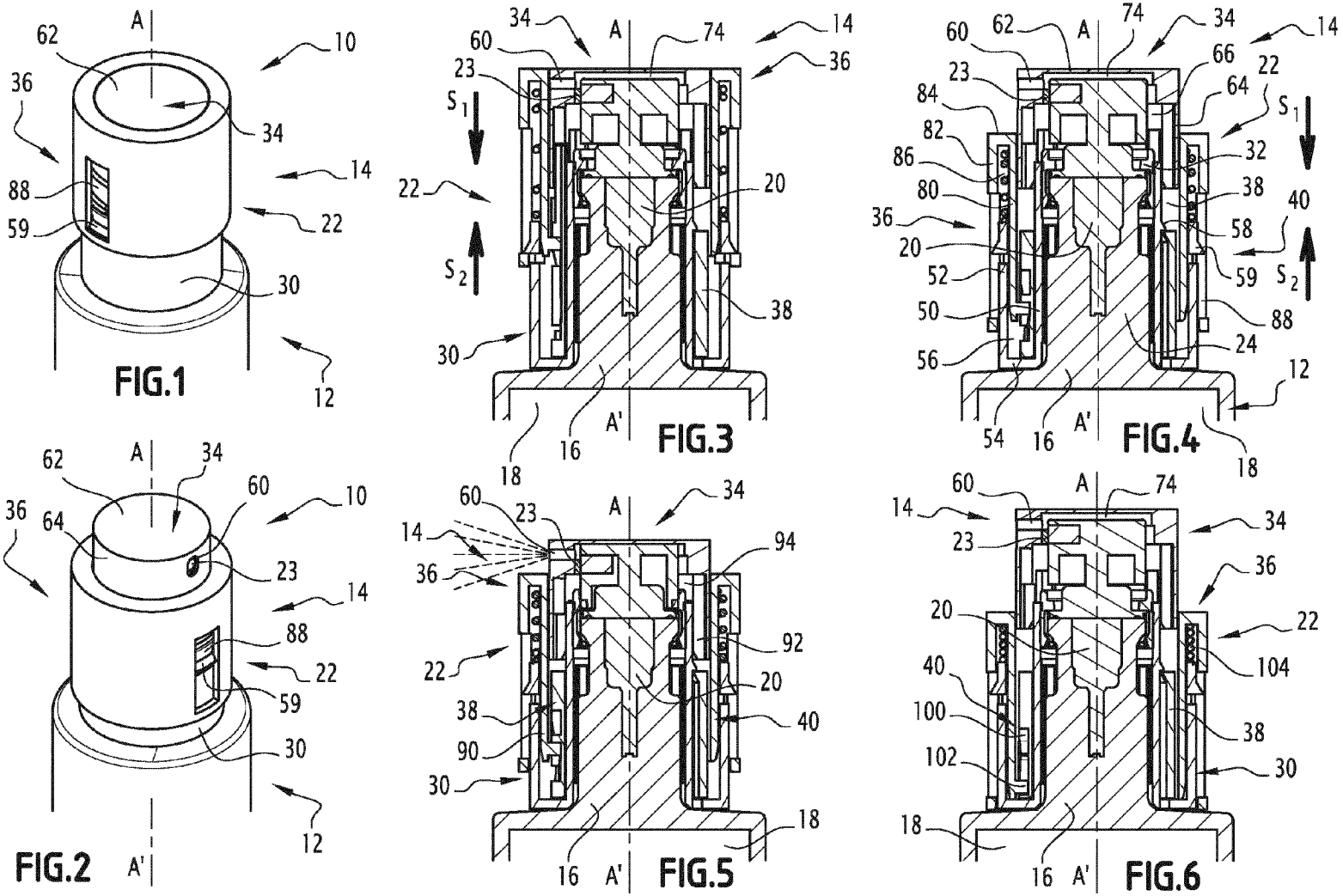
FIG. 1 is a partial perspective three-quarter front view of a first cosmetic product packaging set, equipped with a casing and protective device according to the invention, occupying a protective configuration.
FIG. 2 is a view similar to FIG. 1, the casing and protective device occupying an operating configuration.
FIG. 3 is a sectional view along a medial axial plane of the dispensing head of the set in FIG. 1, in the protective configuration.
FIG. 4 is a view similar to FIG. 3, in the operating configuration thereof.
FIG. 5 is a view similar to FIG. 3, during the dispensing of a cosmetic product.
FIG. 6 is a view similar to FIG. 3, in an intermediate configuration for switching to the protective configuration.

FIGS. 9 to 13 schematically illustrate various configurations of a mechanism for actuating the intermediate member by means of the band of the casing and protective device when switching from the protective configuration to the operating configuration, and when dispensing product.

Hereinafter, the terms "inner" and "outer" are generally used with respect to the contents of a receptacle. The term "inner" generally means closer to the contents, whereas the term "outer" means further from the contents.

A first cosmetic product packaging and dispensing set 10 according to the invention is illustrated in FIGS. 1 to 12.

The cosmetic product is for example a gel, a cream, a lotion, a perfume or a powder.

The cosmetic product will be applied onto a surface of a user's body, such as the user's skin or keratin fibers.

The first set 10 comprises a receptacle 12 for containing the cosmetic product and a dispensing head 14 for dispensing the cosmetic product contained in the receptacle 12 from the receptacle, for example in spray or aerosol form.

The receptacle 12 comprises a neck 16 around which the dispensing head 14 is mounted. It defines an inner volume 18 for receiving the cosmetic product opening outward via the neck 16.

The dispensing head 14 comprises a member 20 for dispensing cosmetic product mounted on the receptacle 12 opposite the neck 16, and a casing and protective device 22 according to the invention covering the dispensing member 20.

The product dispensing member 20 is intended to convey the cosmetic product contained in the inner volume 18 of the receptacle 12 outward via the head 14.

It comprises a pump or a valve, for example.

In this example, the product dispensing member 20 consists of a pump force-fitted on a sealing member, for example crimped.

The product dispensing member 20 extends along a central axis A-A' represented as vertical in FIGS. 3 to 6. The product dispensing member 20 defines a product dispensing nozzle 23 which opens outward, advantageously transversally in relation to the axis A-A'.

The casing and protective device 22 comprises a base support 30 attached to the neck 16 by means of an attachment assembly 32.

According to the invention, the device 22 comprises a member 34 for actuating the dispensing of cosmetic product, suitable for moving between an idle position and a cosmetic product dispensing position, and a band 36 arranged around the actuating member 34, the band 36 being suitable for moving between a protective configuration of the actuating member 34 and an operating configuration of the actuating member 34.

The device 22 further comprises an intermediate locking member 38, suitable for occupying a position for locking the actuating member 34 in the idle position thereof, when the band 36 is in the protective configuration.

The device 22 further comprises a mechanism 40 for actuating the intermediate locking member 38, suitable for moving the intermediate member 38 to a position for releasing the actuating member 34 when switching the band 36 to the operating configuration.

As illustrated in FIG. 4, the base support 30 comprises an inner sleeve 50 fitted around the neck 16, an outer sleeve 52 arranged around and at a radial distance from the inner sleeve 50, and an intermediate bottom wall 54 connecting the inner sleeve 50 to the outer sleeve 52.

The sleeves 50, 52 and the bottom wall 54 define an intermediate annular space 56 opening at the top for receiving the intermediate member 38 and guiding the band 36.

The support 30 defines, advantageously in the vicinity of the top edge of the inner sleeve 50, an abutment 58 for limiting the travel of the actuating member 34. The support 30 further defines, advantageously in the vicinity of the free edge of the outer sleeve 52, an indexing abutment 59 for locking in rotation and limiting the translation travel of the band 36.

The actuating member 34 is mounted externally around the dispensing member 20. It defines a product dispensing channel 60, suitable for being positioned opposite the dispensing nozzle 23 for guiding the cosmetic product from the reservoir 18 and the dispensing member 20, out of the set 10.

The actuating member 34 comprises an outer sealing partition 62, advantageously transversal in relation to the axis A-A' and a side partition 64 projecting inward from the outer partition 62.

The dispensing member 20 is received partially in an inner space 66 defined between the partitions 62, 64.

The channel 60 opens upstream into the inner space 66. In this example, it extends transversally through the side partition 64.

The side partition 66 extends around the intermediate member 38, between the intermediate member 38 and the band 36.

Figures 7, 8, 9, 10, 11, 12, 13:
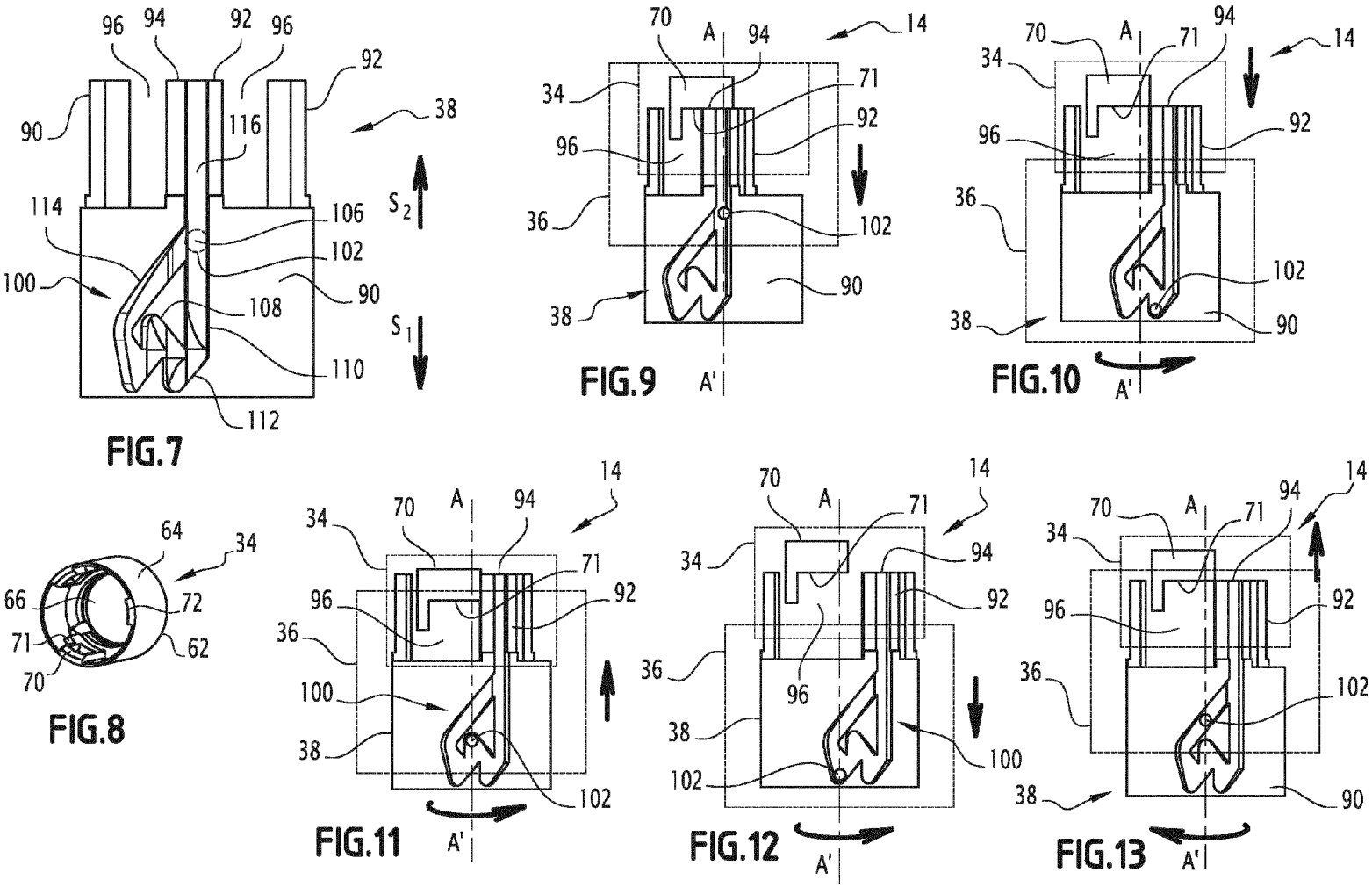
FIG. 7 is a front view of an intermediate member of the casing and protective device equipped with a guiding track.
FIG. 8 is a partial perspective bottom view of an actuating member for dispensing a cosmetic product, of the casing and protective device.

As illustrated in FIG. 8, the actuating member 34 comprises at least one locking abutment 70 suitable for engaging with the intermediate member 38 and a travel-locking projection 72.

The locking abutment 70 projects radially toward the axis A-A' in the intermediate space 66. It defines an inner shoulder 71 suitable for engaging with the intermediate member 38.

The projection 72 projects radially toward the axis A-A', advantageously from the free edge of the side partition 64. It is suitable for engaging with the locking abutment 58.

The actuating member 34 is slidably mounted along an axis A-A' for moving between the idle position illustrated in FIG. 4 and the dispensing position illustrated in FIG. 5.

In the idle position, shown in FIG. 4, the actuating member 34 is at an axial interval from the dispensing member 20. There is a functional gap 74 between the actuating member 34 and the dispensing member 20, particularly between the outer partition 62 and the outer surface of the dispensing member 20.

The functional gap 74 prevents the dispensing member 20 from being actuated in the case of accidental contact of the user of the device or an object with the actuating member 34.

The nozzle 23 is at an axial interval from the channel 60 and is advantageously positioned opposite a solid portion of the partition 64.

The projection 72 and the abutment 58 are in contact, preventing the axial outward movement of the actuating member 34 from the idle position.

Advantageously, an elastic actuating member (not shown) is inserted between the support 30 and the intermediate member 38 to continuously actuate the actuating member 34 to the idle position. Alternatively, the actuating member 34 may be held in the idle position by an abutment mechanism described hereinafter.

In the dispensing position, the actuating member 34 has slid inward, along the axis A-A' in the band 36, to come into contact with and push the dispensing member 20.

The channel 60 is then positioned opposite the nozzle 23 to receive the cosmetic product from the receptacle 18 and transferred via the dispensing member 20. The projection 72 has moved inward away from the abutment 58.

With reference to FIG. 4, the band 36 comprises an inner skirt 80, an outer skirt 82 and an outer connecting wall 84 connecting the skirts 80, 82.

The inner skirt 80 extends around the side partition 64 of the actuating member 34 and around the intermediate member 38. It is received at least partially in the intermediate space 56 between the inner sleeve 50 and the outer sleeve 52, advantageously in contact with the outer sleeve 52.

The outer skirt 82 extends around and at a radial interval from the inner skirt 80. It encompasses at least partially the outer sleeve 52. It defines, with the inner skirt 80, an intermediate annular space 86. The outer sleeve 52 is received in the intermediate space 86.

The top wall 84 extends transversally in relation to the axis A-A'. It seals the intermediate space 86 at the top.

The outer skirt 82 defines an axial housing 88 for receiving and circulating the indexing abutment 59. In this example, the housing 88 consists of a through slit opening outward and into the intermediate space 86.

The indexing stop 59 engages with the side edges of the housing 88 to form a mechanism for locking the rotation of the band 36 about the axis A-A'.

According to the invention, the band 36 is thus suitable for moving from the protective configuration shown in FIG. 3, to the operating configuration shown in FIG. 4 by sliding along the axis A-A', in a first inward direction S1 along a first path, and in a second outward direction S2 along a second path, shorter than the first path in length.

Conversely, the band 36 is suitable for moving from the operating configuration to the protective configuration, by sliding along the axis A-A', in a first inward direction S1 along a third path, and in a second outward direction S2 along a fourth path, greater than the first path in length.

In the protective configuration, shown in FIG. 3, the band 36 is extended outward in relation to the dispensing member 20, to the support 30 and to the receptacle 12. The band 36 covers the actuating member 34 in a radially outward manner. It seals the dispensing channel 60 from the outside.

The intermediate member 38 is thus received in the band 36, without extending beyond same. Advantageously, in the example shown in FIG. 3, the outer partition 62 of the actuating member 34 is flush with the top connecting wall 84 of the band 36.

The indexing abutment 59 is positioned in contact with an inner edge of the housing 88 to prevent the outward movement of the band 36 beyond the protective configuration.

In the operating configuration, represented in FIG. 4, the band 36 is retracted inward in relation to the dispensing member 20, support 30 and receptacle 12.

The actuating member 34 is partially uncovered and projects partially outward beyond the band 36. The space opposite the dispensing channel 60 is cleared, the top wall 84 of the band 36 being arranged in axially inward manner in relation to the channel 60.

The indexing abutment 59 is then arranged in the housing 88, away from the inner edge of the housing 88.

With reference to FIGS. 3 to 6, the intermediate member 38 extends between the band 36 and the actuating member 34. It extends advantageously into the band 36, inside the intermediate space 56, capped by the actuating member 34.

As illustrated in FIG. 7, the intermediate member 38 comprises a base 90 and at least one locking cog 92, advantageously a plurality of locking cogs 92, projecting axially from the base 90.

The base 90 revolves about the axis A-A'. It is in the form of a ring, for example. It is arranged between the inner sleeve 50 of the support 30 and the inner skirt 80 of the band 36, outside the inner space 66 defined by the actuating member 34 in the idle position thereof.

Each cog 92 projects axially outward from the base 90. It has a free edge 94 intended to come into contact with the locking abutment 70 provided in the actuating member 34.

Each cog 92 laterally defines notches 96 for inserting the locking abutment 70.

Each cog 92 is partially inserted into the inner volume 66 of the actuating member.

As illustrated in FIGS. 9 to 12, the intermediate member 38 is rotatably mounted in relation to the band 36 and in relation to the actuating member 34 between a position for locking the actuating member 34 in the idle position thereof, illustrated in FIG. 9, and a position for releasing the actuating member 34, illustrated in FIG. 10.

In the locking position, shown in FIG. 9, at least one cog 92 is arranged axially opposite a locking abutment 70.

Advantageously, the free edge 94 of the cog 92 is received in the retaining shoulder 71 of the locking abutment 70. The axial movement of the actuating member 34 to the dispensing position is thus fully prevented.

This ensures particularly secure locking of the packaging and dispensing set 10, enabling handling and transport of the set 10 without any risk of untimely leakage of cosmetic product.

In the releasing position, illustrated in FIGS. 10 and 11, the cog 92 has swiveled about the axis A-A' to move angularly away from the abutment 70.

The abutment 70 is then arranged opposite a notch 96 and is free to move axially inward in the notch 96.

With reference to FIGS. 6, 7 and 9 to 12, the actuating mechanism 42 comprises a guiding track 100 provided in the intermediate member 38, a guided member 102 rigidly connected to the band 36 received in the track 100, and an elastic member 104 for actuating the band 36 to the protective configuration thereof, shown in FIG. 6.

The guiding track 100 defines a circuit for cyclically guiding the guided member 102. It comprises a first stable region 106 for housing the guided member 102, a second stable region 108 for housing the guided member 102, axially offset inward in relation to the first region 106.

It further comprises a first track section 110, from the first stable housing region 106, a second W-shaped track section 112 wherein the second stable housing region 108 is situated and a third track section 114 for returning the guided member 102 to the first stable housing region 106.

In this example, the track 100 further comprises an outer section 116 for inserting the guided member 102 into the track 100.

The first track section 110 is advantageously linear. It extends parallel to the axis A-A' from the first stable housing region 106 to the second track section 112.

It receives the guided member 102 when the band 36 moves along the first path in the first direction S1.

The second stable housing region 108 is situated on the central top point of the W in the second track section 112.

An upstream portion of the second track section 112 (on the right in FIG. 7) thus receives the guided member 102 at the end of the first path in the first direction S1, and then for the second path in the second direction S2, until the guided member 102 reaches the second stable housing region 108, when the band 36 is in the operating configuration.

During this movement, the guided member 102 rotates the intermediate member 38 about the axis A-A' by means of engagement between the guided member 102 and the second section 112, from the locking position to the releasing position.

From the second stable housing region 108, a downstream portion of the second track portion 112 receives the guided member 102 for the third path in the first direction S1 and at the start of the fourth path, in the second direction S2.

The third track section 114 is curved and rises outward to the first stable housing position 106. It receives the guided member 102 for the fourth path in the second direction S2. During this movement, the guided member 102 rotates the intermediate member 38 about the axis A-A', by means of engagement between the guided member 102 and the third section 116, from the releasing position to the locking position.

The insertion section 116 extends in this case along a cog 92 and opens outward at the free edge 94 of the cog 92.

The guided member 102 is suitable for moving jointly with the band 36. It is thus suitable for moving by translation along a parallel axis in relation to the axis A-A', during the movement of the band 36 between the protective configuration and the operating configuration.

It projects radially toward the axis A-A' from the inner skirt 80. In this example, it consists of a pin.

With reference to FIG. 6, the elastic actuating member 104 is inserted between the support 30 and the band 36. In this example, it is housed in the intermediate space 86. It is advantageously arranged bearing between the top connecting wall 84 and the free edge of the outer sleeve 52. It is suitable for continuously exerting an outward return force of the band 36.

The operating mode of the dispensing head 14 according to the invention will now be described.

Initially, the head 14 is mounted on the neck 16 of the receptacle 12 filled with a cosmetic product to seal the receptacle 12.

The casing and protective device 22 is engaged around the dispensing member 20 and is secured in position.

As illustrated in FIG. 1, the band 36 is then in the protective configuration thereof and encompasses the actuating member 34, sealing the channel 60.

The actuating member 34 is arranged axially away from the dispensing member 20 to prevent actuation of the dispensing member 20.

In this configuration, the guided member 102 is positioned in the first stable housing region 106. The intermediate member 38 is in the position thereof for locking the actuating member 34. At least one cog 92 is thus arranged in contact with the locking abutment 70, advantageously received in the shoulder 71.

The engagement between the cog 92 and the locking abutment 70 locks the movement of the actuating member 34 from the idle position to the dispensing position.

Untimely dispensing of a cosmetic product from the head 14 is thus prevented.

When a user wishes to dispense cosmetic product, the user moves the band 36 axially along the axis A-A' in the first direction S1 along the first path.

The guided member 102 moves in conjunction with the band 36, successively in the first section 110, and in the upstream portion of the second section 112 to the bottom of the first arm of the W (FIG. 10). The user then releases the band 36 which rises in the second direction S2 under the effect of the elastic actuating member 104 (FIG. 11).

The movement of the guided member 102 in the upstream portion of the second section 112 rotates the intermediate device 38 from the locking position thereof to the releasing position thereof.

The locking abutment 70 is then situated opposite a notch 96, away from each cog 92, enabling the movement of the actuating member 34 inward from the idle position thereof.

The band 36 then reaches the operating configuration thereof when the guided member 102 occupies the second stable housing region 108. It is held in this configuration, counter to the return force of the elastic actuating member 104 by the engagement between the guided member 102 and the track 100 in the second stable housing region 108.

In the operating configuration, the actuating member 34 protrudes from the band 36. The channel 60 is cleared.

The user then presses the actuating member 34 and moves same inward along the axis A-A' until it comes into contact with the dispensing member 20. This contact causes cosmetic product to be dispensed outside the head 14, via the dispensing member 20, the nozzle 23 and the channel 60 (FIG. 5).

The user then releases the actuating member 34. The actuating member 34 returns to the idle position thereof.

When the user no longer wishes to use the set 10, the band 36 is moved once again in the first direction S1 inward along the third path to reach the intermediate configuration illustrated in FIGS. 6 and 12.

The guided member 102 moves in conjunction with the band 36 successively in the downstream portion of the second section 112 to the bottom of the second arm of the W.

The user then releases the band 36 which rises in the second direction S2, under the effect of the elastic actuating member 104.

During this movement, the guided member 102 rises in the third section 114 to the first stable housing region 106, rotating the intermediate member 38 from the releasing position thereof to the locking position thereof.

The procedure for using the head 14 and the casing and protective device 22 is thus particularly simple and pleasant for the user, since it merely requires a translation movement of the band, whether for switching from the protective configuration to the operating configuration, or from the operating configuration to the protective configuration.

The movement of the band 36 in the first direction S1 is advantageously carried out by means of user action, whereas the movement in the second direction S2 is advantageously a return movement caused for example by an elastic actuating member.

The casing and protective device 22 confines, extremely securely, the cosmetic product contained in the receptacle 12 when the set 10 is not used, due to the presence of the intermediate locking member 38 preventing the movement of the actuating member 34 in the protective configuration.

The presence of a functional gap 74 between the actuating member 34 and the dispensing member 20 in the protective configuration, further reduces the risk of actuating the dispensing member 20.

Furthermore, the casing and protective device 22 is particularly compact, enabling the fitting thereof to receptacles of varied sizes, while retaining a very visually appealing appearance and a low cost.

The invention claimed is:

1. Casing and protective device for a cosmetic product dispensing head to be mounted on a neck of a receptacle, comprising:

an actuating member for actuating the dispensing of cosmetic product, suitable for moving between an idle position and a cosmetic product dispensing position;

a protective band, intended to extend around the actuating member in the idle position, the band being suitable for moving in a first direction, then in a second opposite direction along a displacement axis for moving from a protective configuration of the actuating member, to an operating configuration of the actuating member, wherein the actuating member protrudes from the band, the band being suitable for moving in the first direction, and in the second direction along the axis from the operating configuration to the protective configuration, the device comprising:

an intermediate locking member arranged between the band and the actuating member, the intermediate member being suitable for moving between a locking position for locking the actuating member in the idle position thereof and a releasing position for releasing the actuating member, when switching the band between the protective configuration and the operating configuration.

2. Device according to claim 1, wherein the intermediate member is rotatably mounted about the displacement axis in relation to the band and the actuating member between the locking position and the releasing position.

3. Device according to claim 1 or 2, comprising an actuating mechanism connecting the intermediate member and the band to induce the movement of the intermediate member between the locking position and the releasing position when moving the band between the protective configuration and the operating configuration.

4. Device according to claim 3, wherein the actuating mechanism comprises a guiding track provided in the intermediate member and the band, and a guided member rigidly connected to the other of the intermediate member and the band, the guided member being received in the guiding track.

5. Device according to claim 4, wherein the guiding track defines at least two stable regions for housing the guided member at an axial interval along the displacement axis.

6. Device according to claim 1 or 2, wherein it comprises an elastic member for actuating the band to the protective configuration thereof.

7. Device according to claim 1 or 2, wherein the intermediate member comprises at least one cog, the cog defining an adjacent lateral notch, the actuating member comprising a locking abutment suitable for bearing on the cog in the locking position and suitable for being housed in the notch in the releasing position.

8. Device according to claim 1 or 2, comprising a mechanism for locking the band in rotation, the band being suitable for moving solely in translation along the displacement axis between the protective configuration and the operating configuration.

9. Cosmetic product dispensing head, comprising:

a cosmetic product dispensing member to be mounted on a neck of a receptacle containing a cosmetic product;

a device according to claim 1 or 2, covering the dispensing member (20).

10. Head according to claim 9, wherein a functional gap is provided along the displacement axis between the dispensing member and the actuating member in the idle position of the actuating member.

11. Head according to claim 10, comprising an elastic member for actuating the actuating member to the idle position thereof.

12. Head according to claim 9, wherein the dispensing member is chosen from a pump or a valve.

13. Cosmetic product packaging and dispensing set comprising a receptacle for receiving the cosmetic product, the receptacle comprising a neck, the set comprising a head according to claim 9, mounted on the neck.

14. Cosmetic product dispensing method, comprising the following steps:

providing a set according to claim 13, the actuating member being positioned in the idle position thereof and the band being positioned in the protective configuration thereof;

moving the band in a first direction and in a second direction along the displacement axis to switch the band to the operating configuration;

switching the intermediate member from the locking position thereof to the releasing position thereof;

moving the actuating member between the idle position and the dispensing position, to cause the product to be dispensed.

15. Method according to claim 14, comprising, after dispensing the cosmetic product, the following steps:

moving the band in the first direction, then in the second direction along the movement axis to switch the band to the protective configuration;

switching the intermediate member from the releasing position thereof to the locking position thereof.

* * * * *